US011663931B2

(12) United States Patent
Huntington

(10) Patent No.: US 11,663,931 B2
(45) Date of Patent: May 30, 2023

(54) MAGNETIC DISHWASHER STATUS INDICATOR

(71) Applicant: Stewart Huntington, Marietta, GA (US)

(72) Inventor: Stewart Huntington, Marietta, GA (US)

( * ) Notice: Subject to any disclaimer, the term of this patent is extended or adjusted under 35 U.S.C. 154(b) by 0 days.

(21) Appl. No.: 17/481,118

(22) Filed: Sep. 21, 2021

(65) Prior Publication Data

US 2022/0093011 A1 Mar. 24, 2022

Related U.S. Application Data

(60) Provisional application No. 63/081,319, filed on Sep. 21, 2020.

(51) Int. Cl.

| | |
|---|---|
| ***G09F 3/20*** | (2006.01) |
| ***G09F 3/18*** | (2006.01) |
| ***G09F 3/02*** | (2006.01) |

(52) U.S. Cl.

CPC ..... *G09F 3/20* (2013.01); *G09F 3/02* (2013.01); *G09F 3/185* (2013.01); *G09F 2003/0208* (2013.01)

(58) Field of Classification Search

CPC ..... G08B 21/245; A47L 15/4257; A47L 15/4293; G09F 23/0058; G09F 2003/0208

See application file for complete search history.

(56) References Cited

U.S. PATENT DOCUMENTS

| | | | | |
|---|---|---|---|---|
| D345,829 | S * | 4/1994 | Mancuso | D32/3 |
| 9,119,522 | B1 * | 9/2015 | Barksdale | A47L 15/4293 |
| 2014/0041573 | A1 * | 2/2014 | Patzer | G09F 7/10 116/321 |
| 2015/0194080 | A1 * | 7/2015 | Saunders | G09F 11/00 40/491 |

* cited by examiner

*Primary Examiner* — David R Dunn
*Assistant Examiner* — Christopher E Veraa
(74) *Attorney, Agent, or Firm* — Jones IP Law, LLC; Dennis W. Jones

(57) ABSTRACT

A magnetic dishwasher status indicator, having a magnetic slider to alternately cover and reveal an indicator status label to show whether dishes are clean or dirty, the magnetic slider including a slider magnet providing for snapping the magnetic slider into place via one of a pair of base magnets within the indicator base.

4 Claims, 7 Drawing Sheets

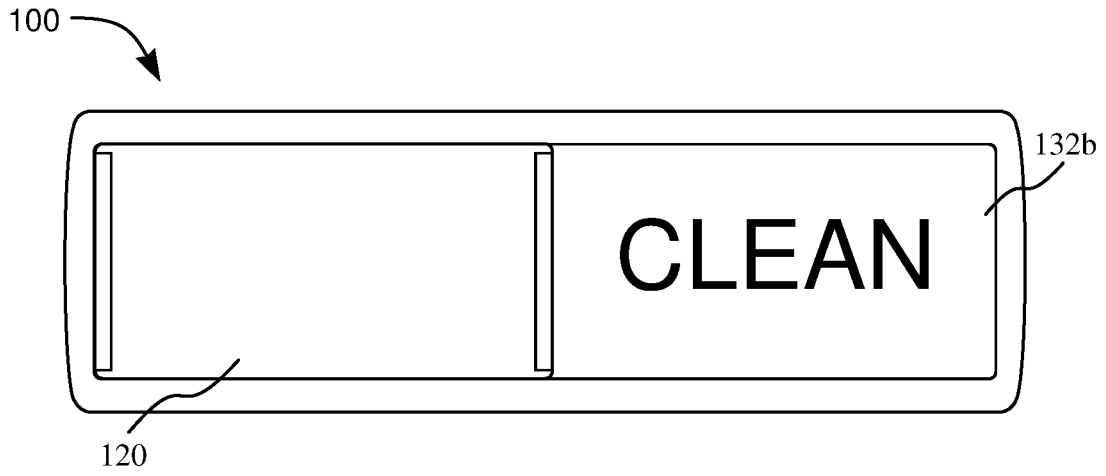
Fig. 3-A
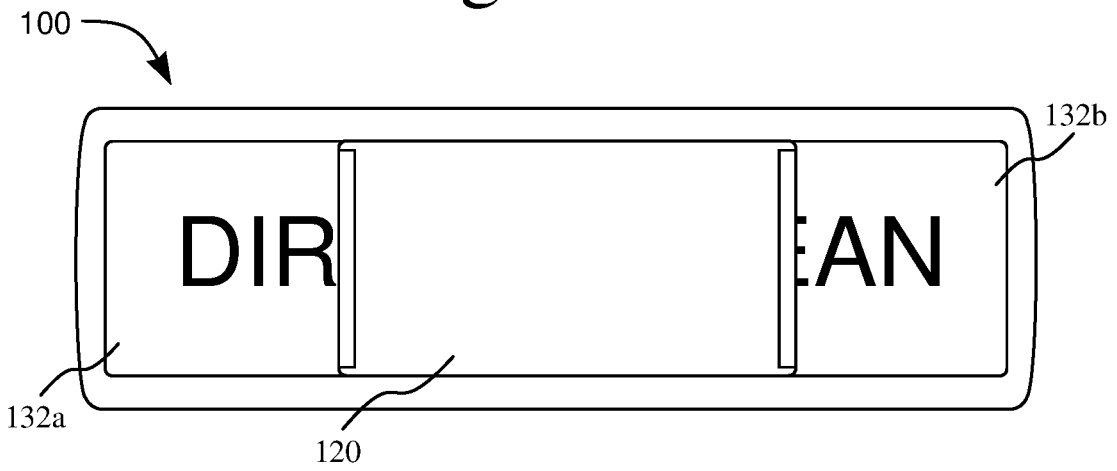
Fig. 3-B
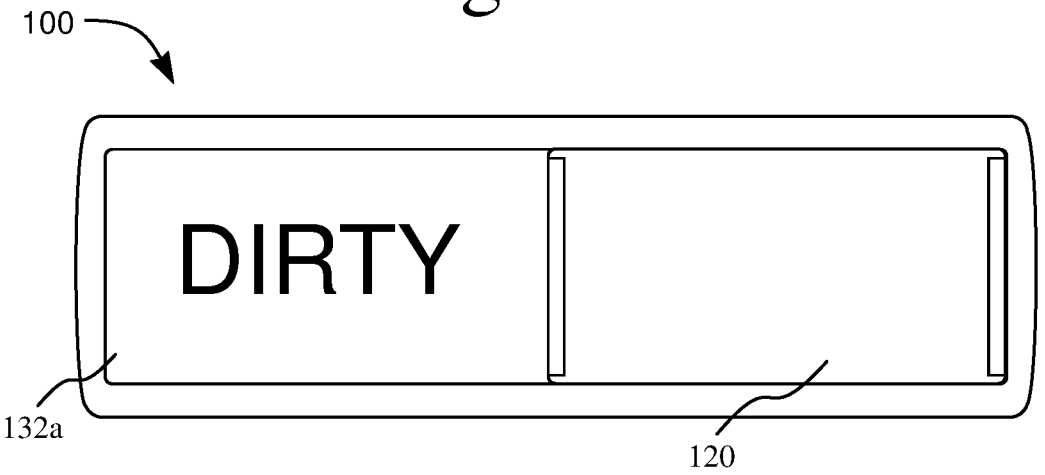
Fig. 3-C

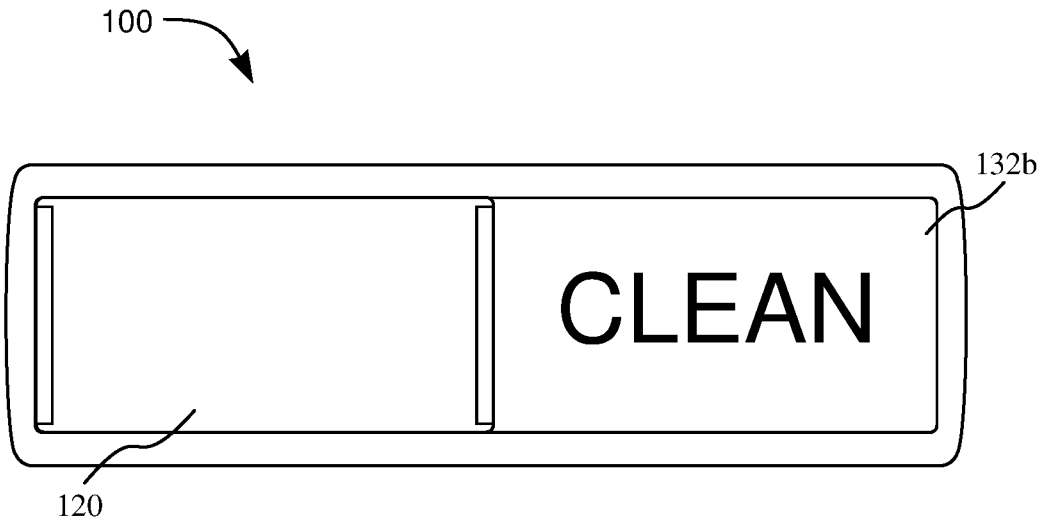
Fig. 4-A
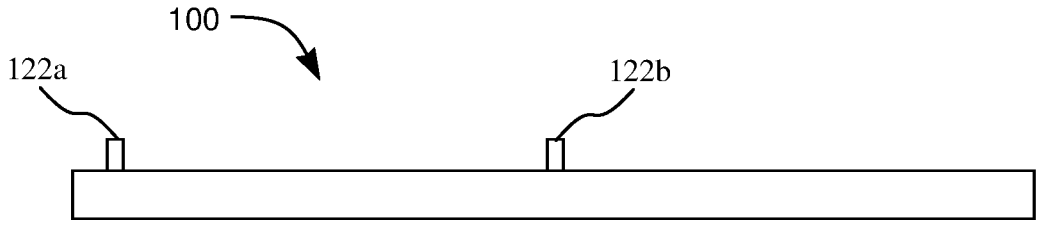
Fig. 4-B

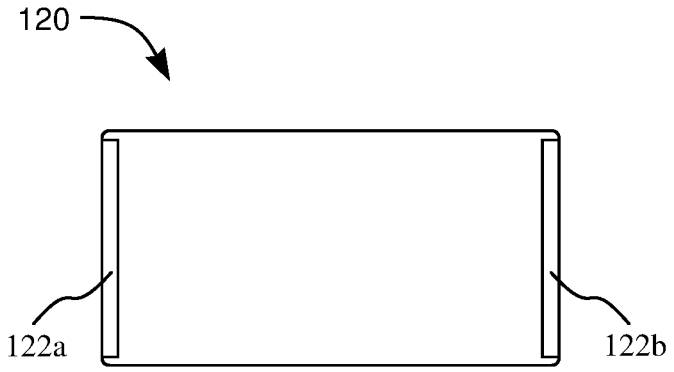
Fig. 5-A
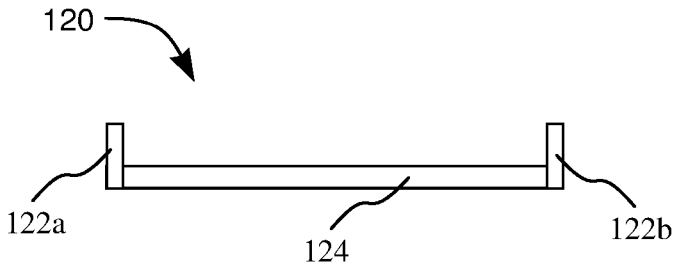
Fig. 5-B
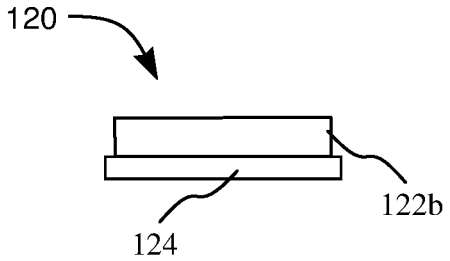
Fig. 5-C
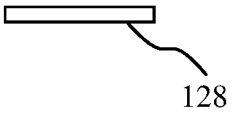
Fig. 5-D
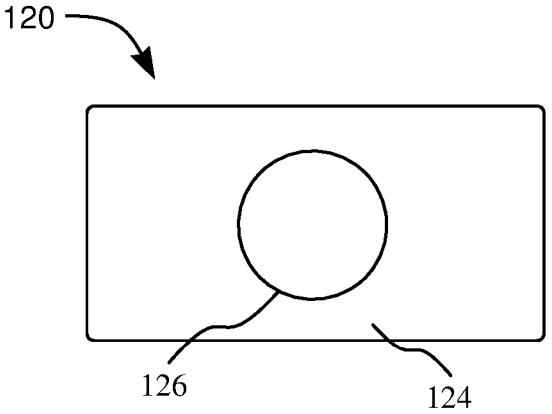
Fig. 5-E

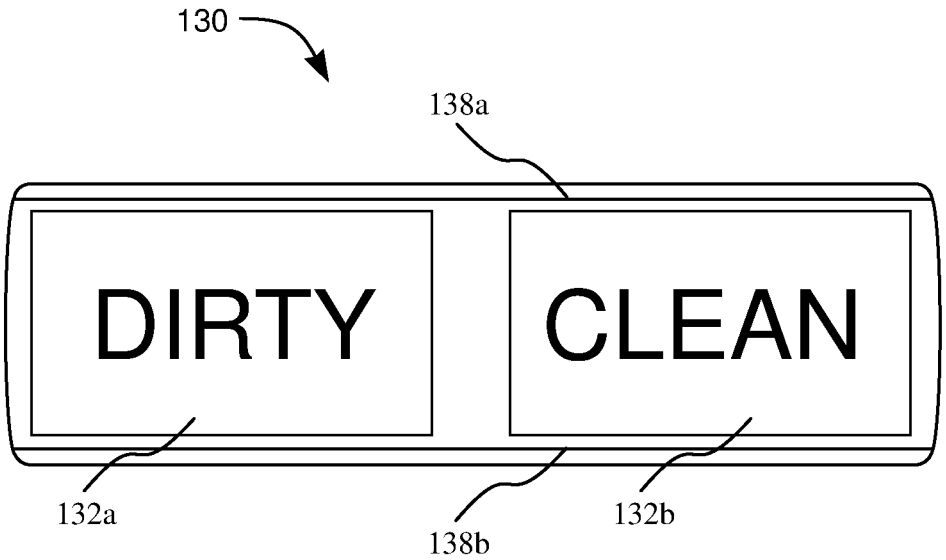
Fig. 6-A
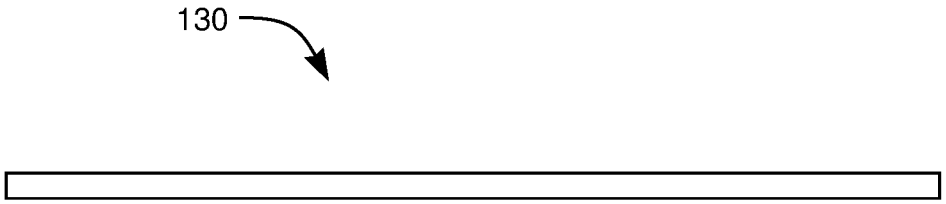
Fig. 6-B

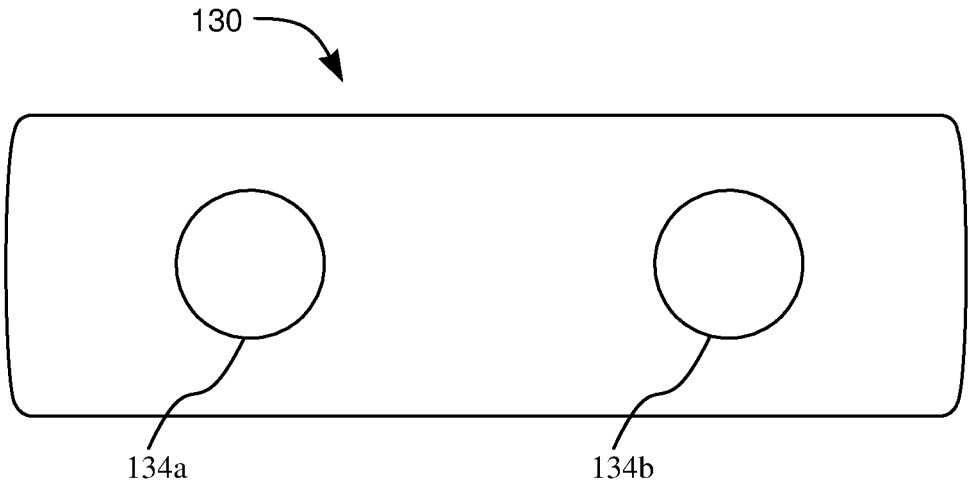
Fig. 6-C
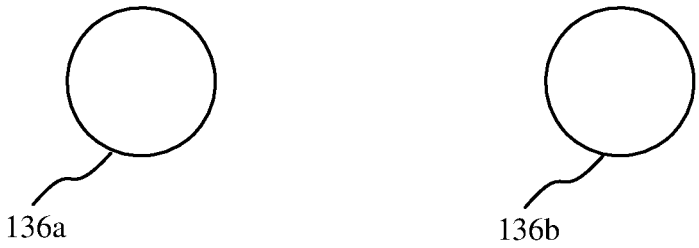
Fig. 6-D
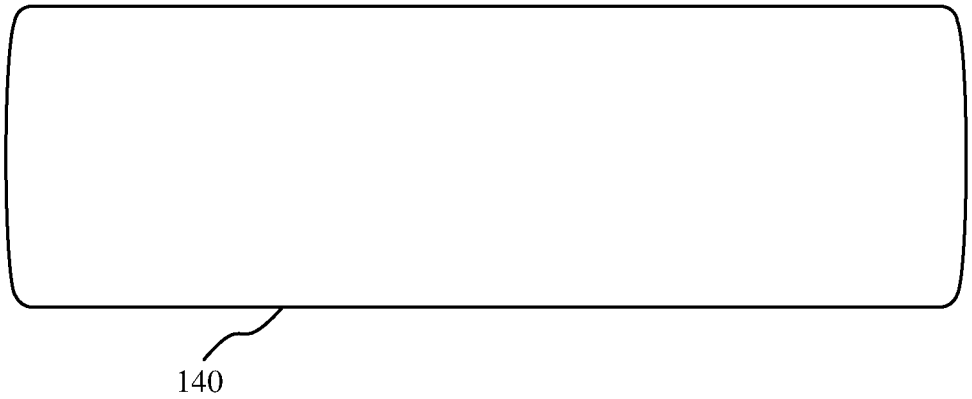
Fig. 7

MAGNETIC DISHWASHER STATUS INDICATOR

BACKGROUND

This invention pertains to appliances, and more especially to automatic dishwashers. More particularly, this invention pertains to a magnetic status indicator that provides for indicating whether the contents within the dishwasher are dirty or clean. Status indicator devices are often utilized with adjustable covers to conceal and/or reveal labels that indicate whether the contents of the dishwasher are dirty or clean.

BRIEF SUMMARY

According to one embodiment of the present invention, a magnetic dishwasher status indicator includes a frame, a magnetic slider, a slider magnet within the magnetic slider, an indicator base, a pair of base magnets within the indicator base, and an adhesive base cover.

In one embodiment, the magnetic dishwasher status indicator, includes a magnetic slider to alternately cover and reveal a status indicator label to reveal whether dishes are clean or dirty, the magnet slider including a slider magnet to provide for snapping into place via a pair of magnets within the indicator base.

In a typical embodiment, the magnetic dishwasher status indicator is affixed to the surface of a dishwasher or other appliance so that the magnetic slider is positionable to cover one of the respective DIRTY/CLEAN status indicator labels while the remaining status indicator label remains uncovered. In this way, a quick glance at the magnetic dishwasher status indicator provides instant knowledge whether the dishes contained within the dishwasher are clean or dirty. The magnetic slider is easily adjustable between the two positions via a slider magnet within the magnetic slider in conjunction with the pair of base magnets within the indicator base.

The combination of the slider magnet and one of the respective base magnets provide for maintaining the magnetic slider in position over the respective indicator label, so that the attraction between the slider magnet and the respective base magnet holds the magnetic slider in place over the respective indicator label.

The indicated status is changed via moving the magnetic slider back and forth along the surface of the indicator base to hide and/or reveal the respective indicator label. When the magnetic slider is moved along the surface of the indicator base the slider magnet within the magnetic slider and the respective base magnet within the indicator base operate to snap the magnetic slider into the new position over the respective base magnet. After snapping into place, the magnetic slider is held in position via the magnetic attraction between the slider magnet and the respective base magnet. That is, the attraction between the slider magnet and the respective base magnet holds the magnetic slider in place over the respective indicator label.

Other systems, methods, features and advantages of the present invention will be or become apparent to one with skill in the art upon examination of the following drawings and detailed description. It is intended that all such additional systems, methods, features and advantages be included within this description and be within the scope of the present disclosure.

BRIEF DESCRIPTION OF THE DRAWINGS

The above-mentioned features will become more clearly understood from the following detailed description read together with the drawings in which:

FIG. 3-A is a front view of the magnetic status indicator of FIG. 1 and illustrating a status via the magnetic slider position;

FIG. 3-B is a front view of the magnetic status indicator of FIG. 1 and illustrating operation of the magnetic slider;

FIG. 3-C is a front view of the magnetic status indicator of FIG. 1 and illustrating a status via the magnetic slider position;

FIG. 4-A is a front view of the magnetic status indicator of FIG. 1;

FIG. 4-B is a side view of the magnetic status indicator of FIG. 1;

FIG. 5-A is a top view of the magnetic slider of the magnetic status indicator of FIG. 1;

FIG. 5-B is a side view of the magnetic slider of the magnetic status indicator of FIG. 1;

FIG. 5-C is an end view of the magnetic slider of the magnetic status indicator of FIG. 1;

FIG. 5-D is a side view of the slider magnet of the magnetic slider of the magnetic status indicator of FIG. 1;

FIG. 5-E is a rear view of the magnetic slider of the magnetic status indicator of FIG. 1;

FIG. 6-A is a top view of the indicator base of the magnetic status indicator of FIG. 1;

FIG. 6-B is a side view of the indicator base of the magnetic status indicator of FIG. 1;

FIG. 6-C is a bottom view of the indicator base of the magnetic status indicator of FIG. 1;

FIG. 6-D is a view of the base magnets base of the magnetic status indicator of FIG. 1; and FIG. 7 is a view illustrating the base cover adhesive portion for the base of the magnetic status indicator.

DETAILED DESCRIPTION

A magnetic status indicator for a dishwasher, having a slider to alternately cover and reveal a status indicating whether dishes are clean or dirty, the slider including a magnet providing for snapping into place via a pair of magnets within the base of the indicator, is disclosed. The magnetic status indicator provides for indicating whether the contents within the dishwasher are dirty or clean.

The magnetic dishwasher status indicator, includes a magnetic slider to alternately cover and reveal a status indicator label to reveal whether dishes are clean or dirty, the magnet slider including a slider magnet to provide for snapping into place via a pair of magnets within the indicator base.

In a typical embodiment, the magnetic dishwasher status indicator is affixed to the surface of a dishwasher or other appliance so that the magnetic slider is positionable to cover one of the respective DIRTY/CLEAN status indicator labels while the remaining status indicator label remains uncovered. In this way, a quick glance at the magnetic dishwasher status indicator provides instant knowledge whether the dishes contained within the dishwasher are clean or dirty. The magnetic slider is easily adjustable between the two positions via a slider magnet within the magnetic slider in conjunction with the pair of base magnets within the indicator base.

The combination of the slider magnet and one of the respective base magnets provide for maintaining the magnetic slider in position over the respective indicator label, so that the attraction between the slider magnet and the respective base magnet holds the magnetic slider in place over the respective indicator label.

The indicated status is changed via moving the magnetic slider back and forth along the surface of the indicator base to hide and/or reveal the respective indicator label. When the magnetic slider is moved along the surface of the indicator base the slider magnet within the magnetic slider and the respective base magnet within the indicator base operate to snap the magnetic slider into the new position over the respective base magnet. After snapping into place, the magnetic slider is held in position via the magnetic attraction between the slider magnet and the respective base magnet. That is, the attraction between the slider magnet and the respective base magnet holds the magnetic slider in place over the respective indicator label.

Figure 1:
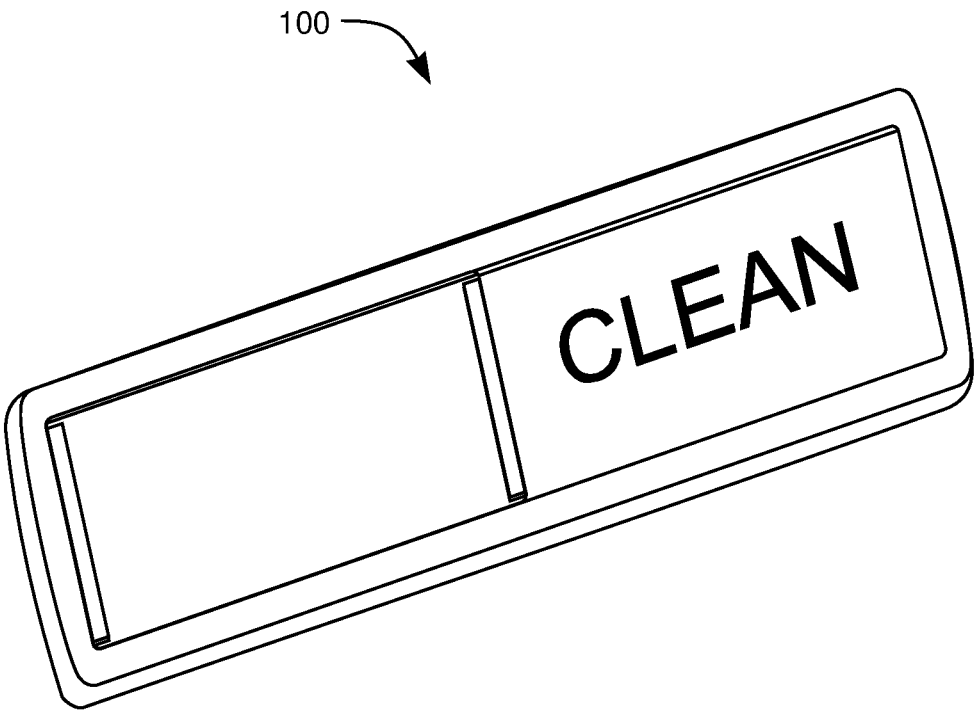
FIG. 1 is a perspective view illustrating a magnetic status indicator.
Figure 2:
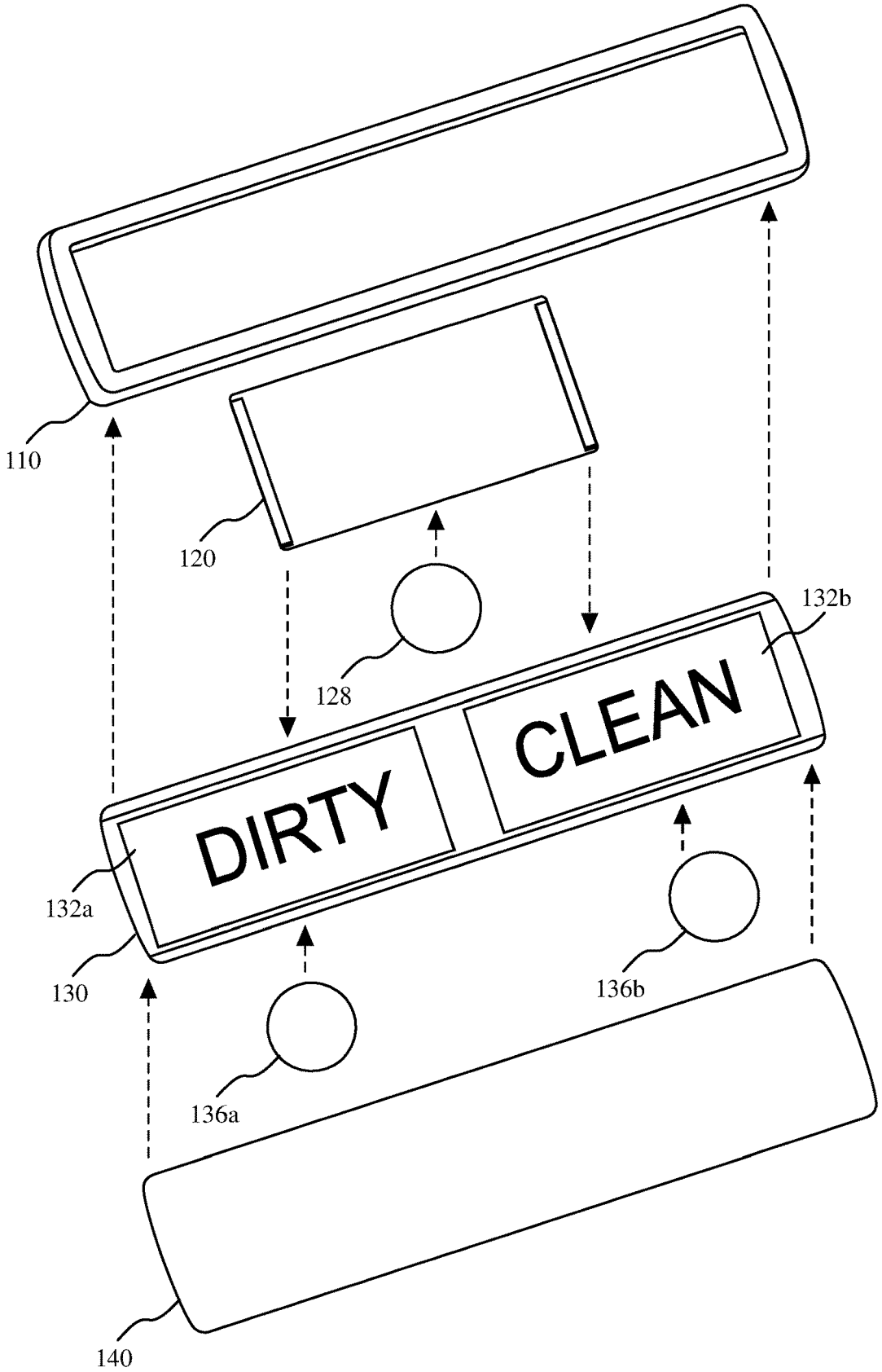
FIG. 2 is an exploded perspective view of the magnetic status indicator of FIG. 1.

FIG. 1 is a perspective view illustrating a magnetic status indicator 100, and FIG. 2 is an exploded diagram of the magnetic status indicator 100. The magnetic status indicator 100 is attachable magnetically to a metal surface and includes a magnetic slider 120 to provide or reveal an indication of whether the contents (dishes, etc.) within the dishwasher are clean or dirty. In the illustrated embodiment, the magnetic status indicator 100 includes a frame 110, a magnetic slider 120, a slider magnet 128, an indicator base 130, a pair of base magnets 136*a* and 136*b*, and an adhesive base cover 140.

In a typical embodiment, the magnetic status indicator 100 is affixed to the surface of a dishwasher or other appliance so that the magnetic slider 120 is positionable to cover one of the respective DIRTY/CLEAN status indicator labels 132*a* or 132*b* while the remaining status indicator label remains uncovered. In this way, a quick glance at the magnetic status indicator 100 provides instant knowledge whether the dishes contained within the dishwasher are clean or dirty. The magnetic slider 120 is easily adjustable between the two positions via a slider magnet 128 within the magnetic slider 120 in conjunction with the pair of base magnets 136*a* and 136*b* within the indicator base 130.

The combination of the slider magnet 128 and one of the respective base magnets 136*a* or 136*b* provide for maintaining the magnetic slider 120 in position over the respective indicator label 132*a* or 132*b*. That is, the attraction between the slider magnet 128 and the respective base magnet 136*a* or 136*b* holds the magnetic slider 120 in place over the respective indicator label 132*a* or 132*b*.

In the illustrated embodiment, the magnetic status indicator 100, the frame 110, the magnetic slider 120, and the indicator base 130 are made from a metal or metal alloy type material suitable for providing a rigid structure capable of providing the herein described operability. In other embodiments, it is envisioned that the various components of the magnetic status indicator 100, are made from various materials such as metal, metallic alloys, rigid plastic, and/or any other material suitable for providing the rigid structures as described herein. That is, the magnetic status indicator, the frame 110, the magnetic slider 120, and the indicator base 130 respectively are each made from either metal, a metallic alloy, a rigid plastic, and/or any other material suitable for providing the rigid structures as described herein for securing the various magnets and providing the herein described operability.

FIG. 3-A is a front view of the magnetic status indicator 100 and illustrating a status via the magnetic slider 120 position, FIG. 3-B is a front view of the magnetic status indicator 100 and illustrating operation of the magnetic slider 120, and FIG. 3-C is a front view of the magnetic status indicator 100 and again illustrating a status via the magnetic slider 120 position. The status, whether DIRTY or CLEAN, of the contents within the dishwasher are indicated via the positioning of the magnetic slider 120. Specifically, the magnetic slider 120 is positioned to cover one of the indicator labels 132*a* or 132*b* while leaving the remaining indicator label 132*a* or 132*b* revealed or visible. The indicator label 132*a* or 132*b* that is visible is indicative of the status for the dishwasher contents, that is, either DIRTY or CLEAN.

The indicated status is changed via moving the magnetic slider 120 back and forth along the surface of the indicator base 130 to hide and/or reveal the respective indicator label 132*a* or 132*b*. When the magnetic slider 120 is moved along the surface of the indicator base 130 the slider magnet 128 within the magnetic slider 120 and the respective base magnet 136*a* or 136*b* within the indicator base 130 operate to snap the magnetic slider 120 into the new position over the respective base magnet 136*a* or 136*b*. After snapping into place, the magnetic slider 120 is held in position via the magnetic attraction between the slider magnet 128 and the respective base magnet 136*a* or 136*b*. That is, the attraction between the slider magnet 128 and the respective base magnet 136*a* or 136*b* holds the magnetic slider 120 in place over the respective indicator label 132*a* or 132*b*.

FIG. 4-A is a front view of the magnetic status indicator 100 and FIG. 4-B is a side view of the magnetic status indicator 100. As noted above, the status of the dishwasher contents are indicated via the positioning of the magnetic slider 120. In the illustrated example, the magnetic slider 120 covers or conceals the indicator label 132*a* (DIRTY) so that the corresponding indicator label 132*b* (CLEAN) is visible. The indicator label 132*b* thus indicates that the contents of the dishwasher are or are believed to be CLEAN. In the illustrated example, the magnetic slider 120 is held in position via the magnetic attraction between the slider magnet 128 and the base magnet 136*a*. That is, the attraction between the slider magnet 128 and the base magnet 136*a* holds the magnetic slider 120 in place over the indicator label 132*a*.

The indicated status is adjusted or changed via moving the magnetic slider 120 along the surface of the indicator base 130 to cover the indicator label 132*b* and reveal the corresponding indicator label 132*a* to indicate that contents are DIRTY. When the magnetic slider 120 is moved to the right along the surface of the indicator base 130, the attraction between the slider magnet 128 and the base magnet 136*a* within the indicator base 130 is broken so that the magnetic slider 120 is no longer held in position over the indicator label 132*a*. As the magnetic slider 120 moves toward and to cover the indicator label 132*b*, the magnetic attraction between the slider magnet 128 and the base magnet 136*b* within the indicator base 130 causes the magnetic slider 120 to snap into position and cover the indicator label 132*b* (CLEAN) so that the indicator label 132*a* (DIRTY) becomes visible.

After snapping into place, the magnetic slider 120 is held in position via the magnetic attraction between the slider magnet 128 and the base magnet 136*b*. That is, the attraction between the slider magnet 128 and the base magnet 136*b* holds the magnetic slider 120 in place over the indicator label 132*b*.

The status of the magnetic status indicator 100 can be changed again by reversing this process and moving the magnetic slider 120 back and forth along the surface of the indicator base 130.

FIG. 5-A is a top view of the magnetic slider 120, FIG. 5-B is a side view of the magnetic slider 120, and FIG. 5-C is an end view of the magnetic slider 120. FIG. 5-D is a side view of the slider magnet 128 and FIG. 5-E is a rear view of the magnetic slider 120. The magnetic slider 120 is an essentially flat rectangular structure having tabs or grips 122*a* and 122*b* at either end of a slider base 124. The respective grips 122*a* and 122*b* provide for pushing or sliding the magnetic slider 120 in a direction parallel to its length. That is, the magnetic slider 120 is slideable along the surface of the indicator base 130 on which it resides. The tabs or grips 122*a* and 122*b* protrude upward at each end of the slider base 124 so that the tabs 122*a* and 122*b* are readily accessible above the frame 110 of the magnetic status indicator 100.

The slider magnet 128 fits within a slider magnet opening 126 on the underside or rear of the magnetic slider 120. The slider magnet opening 126 is a circular opening having a depth sufficient for the slider magnet 128 to fit within the magnetic slider 120 and still allow for the magnetic slider to move along the surface of the indicator base 120. The slider magnet opening 126 is substantially centered along the length and width of the underside of the magnetic slider 120. The slider magnet 128 is secured in place within the slider magnet opening 126 via an adhesive such as is common for securing a magnet to a metal, metallic alloy, or other material as described herein.

FIG. 6-A is a top view of the indicator base 130 and FIG. 6-B is a side view of the indicator base 130. FIG. 6-C is a bottom view of the indicator base 130, FIG. 6-D is a view of the base magnets 136*a* and 136*b*. The indicator base 130 includes an indicator label 132*a* and an indicator label 132*b* along its surface. The indicator base 130 also includes respective risers 138*a* and 138*b* along its length just away from the edge on each side.

In the illustrated examples, the indicator label 132*a* is labeled DIRTY and the indicator label 132*b* is labeled CLEAN. Of course, the respective labels can be reversed, if desired. Likewise, the respective labels can be depicted in any suitable language as appropriate. In the illustrated example, the indicator labels 132*a* and 132*b* are made of a covering affixed, applied or secured to the surface of the indicator base 130. Any type covering or paint that is suitable for a metal surface can be suitable for the indicator labels 132*a* and 132*b*.

The risers 138*a* and 138*b* along the length of the indicator base 130 provide a narrow section to provide slight spacing between the magnetic slider 120 and the surface of the indicator base 130. This spacing provides better mobility of the magnetic slider 120 along the length of the indicator base 130 while also protecting the indicator labels 132*a* and 132*b* from being potentially scratched by the movement of the magnetic slider 120 along the length.

The underside of the indicator base 130 is illustrated in FIG. 6-C and includes two base magnet openings 134*a* and 134*b*. Each base magnet opening 134*a* and 134*b* respectively are circular openings having a depth sufficient for the respective base magnet 136*a* and 136*b* to fit within the indicator base 130. Each base magnet opening 134*a* and 134*b* are substantially centered along the width of the indicator base 130. Each base magnet opening 134*a* and 134*b* are positioned along the length of the indicator base so that the corresponding base magnet 136*a* and 136*b* are positioned respectively underneath the indicator labels 132*a* and 132*b*. Each base magnet 136*a* and 136*b* is secured in place within the respective base magnet opening 134*a* and 134*b* via an adhesive such as is common for securing a magnet to a metal, metallic alloy, or other material as described herein.

FIG. 7 is a view illustrating the base cover adhesive portion 140 for the base of the magnetic status indicator 100. The base cover adhesive portion 140 is an adhesive and is applied to the underside of the indicator base 130. The base cover adhesive portion 140 provides a covering for the base magnet openings 134*a* and 134*b* and also for additional securing of the base magnets 136*a* and 136*b* in place within the base magnet openings 134*a* and 134*b*.

In one embodiment, the magnetic status indicator 100 is applied to the surface of an appliance or dishwasher having a metal surface. The base magnets within the indicator base 130 provide for securing the magnetic status indicator 100 in position to a metallic surface.

Alternatively, the base covering is also secureable to a dishwasher or other appliance via hook and loop type fasteners. In one embodiment, hook and loop fasteners are applied to the rear of the magnetic status indicator 100 and also to the surface of the respective appliance or dishwasher. In such an embodiment, the magnetic status indicator 100 can be applied to a non-metallic or non-magnetic surface.

From the foregoing description, it will be recognized by those skilled in the art that a magnetic status indicator 100 affixable to the surface of a dishwasher or other appliance has been provided. The magnetic status indicator 100 includes a magnetic slider 120 that is positionable to cover one of the respective DIRTY/CLEAN status indicator labels 132*a* or 132*b* while the remaining status indicator label remains uncovered. In this way, a quick glance at the magnetic status indicator 100 provides instant knowledge whether the dishes contained within the dishwasher are clean or dirty. The magnetic slider 120 is easily adjustable between the two positions via a slider magnet 128 within the magnetic slider 120 in conjunction with the pair of base magnets 136*a* and 136*b* within the indicator base 130.

The combination of the slider magnet 128 and one of the respective base magnets 136*a* or 136*b* provide for maintaining the magnetic slider 120 in position over the respective indicator label 132*a* or 132*b*. That is, the attraction between the slider magnet 128 and the respective base magnet 136*a* or 136*b* holds the magnetic slider 120 in place over the respective indicator label 132*a* or 132*b*.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A status indicator for a dishwasher, the status indicator comprising:

a frame having a frame length and a frame width, the frame having an opening for viewing contents within the frame;

an indicator base having an indicator base length corresponding to the frame length, the indicator base including a pair of corresponding indicator labels, namely a first indicator label and a second indicator label along a top surface of the indicator base;

a magnetic slider, the magnetic slider visible within the frame and operable for sliding along a pair of risers on the top surface of the indicator base, to reveal one of the first indicator label and the second indicator label while covering the corresponding indicator label, the pair of risers providing spacing between the top surface of the indicator base and a rear underside of the magnetic slider, the magnetic slider further including a slider magnet opening in the rear underside and a slider magnet secured within the slider magnet opening;

a pair of base magnet openings within an underside of the indicator base, each base magnet opening located to correspond respectively to one of the corresponding indicator labels; and a pair of base magnets, each base magnet secured within one of the pair of base magnet openings so that each base magnet correspondingly attracts the slider magnet as the slider magnet moves toward the corresponding indicator label and causing the magnetic slider to snap into position over the respective base magnet, wherein the status indicator reveals an appropriate indicator for whether contents are clean based on which indicator label is revealed.

2. The status indicator of claim 1, further comprising an adhesive cover corresponding to the underside of the indicator base and attachable to the underside of the indicator base for covering the base magnet openings while also providing for securing the status indicator to a surface.

3. The status indicator of claim 1, the magnetic slider further comprising a pair of tabs at each end of the magnetic slider and extending between respective side edges, the tabs provide for gripping the magnetic slider to slide along the indicator base length, so as to break a magnetic hold between the slider magnet and a first respective base magnet and cause an attraction between the slider magnet and a second respective base magnet.

4. The status indicator of claim 1, further comprising the corresponding indicator labels representing DIRTY and CLEAN respectively, so as to indicate a present status of dishware contents within the dishwasher.

* * * * *